US010597222B2

(12) United States Patent
Slavomir

(10) Patent No.: US 10,597,222 B2
(45) Date of Patent: Mar. 24, 2020

(54) PACKAGE FOR TOBACCO-RELATED ARTICLES

(71) Applicant: Reemtsma Cigarettenfabriken GmbH, Hamburg (DE)

(72) Inventor: Novak Slavomir, Hamburg (DE)

(73) Assignee: Reemtsma Cigarettenfabriken GmbH, Hamburg (DE)

( * ) Notice: Subject to any disclaimer, the term of this patent is extended or adjusted under 35 U.S.C. 154(b) by 359 days.

(21) Appl. No.: 15/502,152

(22) PCT Filed: Jul. 22, 2015

(86) PCT No.: PCT/EP2015/001507
§ 371 (c)(1),
(2) Date: Feb. 6, 2017

(87) PCT Pub. No.: WO2016/020041
PCT Pub. Date: Feb. 11, 2016

(65) Prior Publication Data

US 2017/0225878 A1 Aug. 10, 2017

(30) Foreign Application Priority Data

Aug. 7, 2014 (EP) ..... 14002772

(51) Int. Cl.
*B65D 85/10* (2006.01)
*B65D 5/66* (2006.01)

(52) U.S. Cl.
CPC ..... *B65D 85/1045* (2013.01); *B65D 5/6688* (2013.01); *B65D 2203/12* (2013.01)

(58) Field of Classification Search
CPC ..... B65D 85/1045; B65D 5/6688; B65D 2203/12; B65D 85/10; B65D 43/16;
(Continued)

(56) References Cited

U.S. PATENT DOCUMENTS 3,311,283 A * 3/1967 Shimada ..... B65D 5/6688 229/125.08
3,589,505 A * 6/1971 Burniski ..... A24F 15/12 206/250

(Continued)

FOREIGN PATENT DOCUMENTS

CN 1209411 A 3/1999
CN 1669887 A 9/2005

(Continued)

OTHER PUBLICATIONS

PCT International Preliminary Report on Patentability from PCT Application No. PCT/EP2015/001507 entitled Package for Tobacco-Related Articles (dated Feb. 16, 2017).

(Continued)

*Primary Examiner* — Luan K Bui
(74) *Attorney, Agent, or Firm* — Hovey Williams LLP

(57) ABSTRACT

A package for tobacco-related articles including an outer shell, a swivelable lid, and an inner shell adapted to accommodate a plurality of smoking or tobacco-related articles and mounted in the outer shell. The inner shell is moveable towards the top side of the outer shell from a retracted position to an advanced position, which enables access to the smoking articles. A sound-producing mechanism produces a sound when the inner shell is moved from the retracted position to the advanced position and/or in the other direction. The sound-producing mechanism includes at least one part arranged at the inner shell, which interacts in a sound-producing manner with a counterpart arranged at an inner face of the outer shell.

18 Claims, 6 Drawing Sheets

Figure 1:
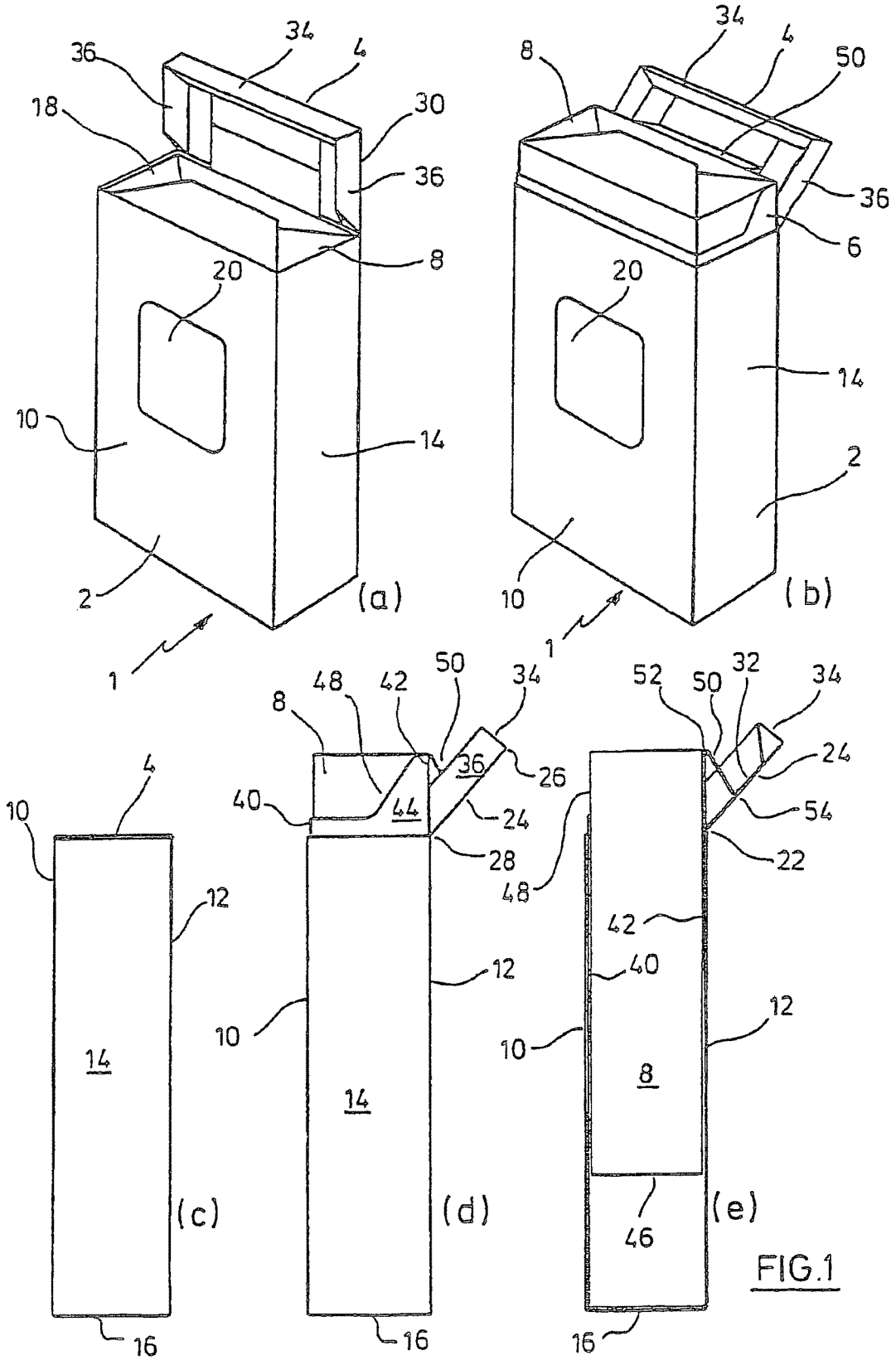

(58) Field of Classification Search
CPC . B65D 5/72; B65D 85/00; B65D 5/00; B65D 85/1009
USPC ..... 206/268, 250, 273, 265, 271; 229/146, 229/160.1, 225, 160.2
See application file for complete search history.

(56) References Cited

U.S. PATENT DOCUMENTS

| | | | | | |
|---|---|---|---|---|---|
| 4,240,548 | A * | 12/1980 | Stio | B65D 85/1009 | 206/250 |
| 4,948,038 | A * | 8/1990 | Moeller | B65D 5/4291 | 206/271 |
| 6,105,856 | A * | 8/2000 | Kakiuchi | B65D 5/4291 | 229/148 |
| 6,334,532 | B1 * | 1/2002 | Tambo | B65D 85/1045 | 206/268 |
| 8,550,241 | B2 * | 10/2013 | Holford | B65D 85/1036 | 206/268 |
| 2003/0116614 | A1 * | 6/2003 | Block | B65D 5/4291 | 229/146 |
| 2010/0320263 | A1 * | 12/2010 | Tawada | B65D 5/6697 | 229/160.1 |
| 2012/0261285 | A1 * | 10/2012 | Holloway | B65D 85/1054 | 206/250 |
| 2018/0215531 | A1 * | 8/2018 | Polloni | B65D 85/1009 | |

FOREIGN PATENT DOCUMENTS

| | | | | |
|---|---|---|---|---|
| CN | 101072720 | A | 11/2007 | |
| CN | 101965294 | A | 2/2011 | |
| CN | 103118960 | A | 5/2013 | |
| CN | 103534176 | A | 1/2014 | |
| EP | 2143663 | A1 * | 1/2010 | B65D 85/10 |
| EP | 2143663 | A1 | 1/2010 | |
| WO | 2011060930 | A1 | 5/2011 | |
| WO | 2013110412 | A1 | 8/2013 | |
| WO | WO2013110412 | A1 * | 8/2013 | B65D 5/38 |
| WO | 2014097201 | A1 | 6/2014 | |

OTHER PUBLICATIONS

Chinese Office Action and Search Report from CN Application No. 201580036113X entitled Paackage for Tobacco-Related Articles (dated Apr. 19, 2018) (includes English translation).
PCT International Search Report from PCT Application No. PCT/EP2015/001507 entitled Package for Tobacco-Related Articles (dated Sep. 7, 2015).

* cited by examiner (a)
(b)
(c)

60
62
63
64
65
66
68
69
70
72
74
75
76
78
10
12
16
24
34
36
50
52
54
40
42
46
80
82
83
84
86
88
90
92
94
L

PACKAGE FOR TOBACCO-RELATED ARTICLES

CROSS-REFERENCE TO RELATED APPLICATIONS

This application is the National Stage of International Patent Application No. PCT/EP2015/001507, filed Jul. 22, 2015, which is hereby incorporated by reference in its entirety, and which claims priority to European Patent Application No. 14002772.3, filed Aug. 7, 2014.

BACKGROUND OF THE INVENTION

1. Field of the Invention

The invention relates to a package for tobacco-related articles, e.g. for cigarettes or for cigarillos.

2. Discussion of the Prior Art

A conventional package for tobacco-related articles comprises a shell having a front wall, a rear wall, two lateral walls opposite to each other and a bottom wall connecting the front wall and the rear wall. The top side of the shell is closed by a lid, which can be opened by swivelling or rotating it about a hinge line provided at the rear wall or one of the lateral walls. For opening or closing such package, the user generally has to apply both of his or her hands.

WO 2011/060930 A discloses a package for tobacco-related articles comprising an outer shell, a lid and an inner shell for accommodating the tobacco-related articles. The inner shell is shiftably mounted in the outer shell and can be moved towards the top side of the outer shell from a retracted position to an advanced position, which enables access to the smoking articles. By means of a connector arranged between a portion of the inner shell and the lid, the lid opens or closes automatically when the inner shell is moved relatively to the outer shell. Moreover, the package may include a noise-producing mechanism comprising a tab arranged at the lid interacting with a counterpart arranged at the outer shell (or vice versa), which creates a noise when the lid opens or closes. The manufacture of such a noise-producing mechanism is relatively expensive, however.

WO 2014/097201 A1 discloses a package for smoking articles in which an inner container can be moved with respect to an outer container in order to provide access to the smoking articles accommodated in the inner container. When a projecting tab arranged at the inner container interacts with a slot at the outer container, a sound is produced.

SUMMARY

It is the object of the invention to provide an attractive package for tobacco-related articles which catches attention when used but nevertheless is moderate-priced.

This object may be achieved according to embodiments of the invention by providing a package for tobacco-related articles like cigarettes or cigarillos. It comprises an outer shell, a lid, and an inner shell. The outer shell has a front wall, a rear wall, two lateral walls opposite to each other connecting the front wall and the rear wall, as well as a top side (and optionally a bottom wall). The lid is adapted to close the top side of the outer shell when in a closed state. It is swivelably connected to the rear wall or one of the lateral walls of the outer shell at a hinge line so that it can be swivelled about this hinge line for transfer from the closed state to an opened state. The inner shell is adapted to accommodate a plurality of tobacco-related articles and is shiftably mounted in the outer shell so that the inner shell can be moved towards the top side of the outer shell from a retracted position to an advanced position, which enables access to the smoking articles.

Moreover, the package comprises a sound-producing mechanism adapted to produce a sound when the inner shell is moved from the retracted position to the advanced position or from the advanced position to the retracted position (or upon movement in both directions). According to the invention, the sound-producing mechanism comprises at least one part arranged at the inner shell. This part is adapted to interact in a sound-producing manner with a counterpart arranged at an inner face of the outer shell.

In this context, the term "part" is used in a general sense. Said part, e.g., may be composed of several sub-parts or components. Or it may be interchanged with the counterpart; the sound being produced by the interaction between part and counterpart, a distinction between part and counterpart is of minor importance. In advantageous embodiments, said part is designed as a protrusion so that the sound-producing mechanism comprises at least one protrusion arranged at the inner shell, plus a counterpart at an inner face of the outer shell. For example, said part may be a protrusion projecting towards a lateral wall of the outer shell. In other embodiments, the sound-producing mechanism comprises at least one protrusion arranged at an inner face of the outer shell, which protrusion interacts in a sound-producing manner with a counter-piece arranged at the inner shell.

The sound produced when the inner shell is advanced and/or retracted is somewhat unusual for a package containing tobacco-related articles and catches attention. Moreover, to the user the sound can serve as a feedback or an indicator that the package has been actuated.

In advantageous embodiments, the inner shell comprises a bottom wall and said part is a protrusion designed as a tab projecting from the bottom wall. In that case, the tab can be made from the material of the bottom wall and can project in a plane defined by the bottom wall. This allows for a compact and cost-effective construction and permits the tab to be made from a blank containing the bottom wall of the inner shell. In other versions, however, the protrusion may be made of a different material, or it may be designed as a separate part attacked to the inner shell.

Moreover, the cantilever length of the tab can be increased by two opposed cut lines in the bottom wall. In this context, the cantilever length means the effective length of the tab along which it may be able to bend or vibrate. Thus, the portion of the tab protruding from the bottom wall of the inner shell may be relatively short compared to the cantilever length, which means that the design does not consume much space. But nevertheless, the tab acts as a relatively long tongue, which may improve the quality of the sound created by the sound-producing mechanism according to the invention.

Generally, the sound much depends on the stiffness of the material used for the tab. If, e.g., the tab is formed from a blank of the inner shell made of cardboard, the stiffness may be influenced by the kind of cardboard and the number of plies in the cardboard.

The free end of the tab, i.e. the protruding end of the tab, may comprise at least one bevelled or rounded edge. Bevelled or rounded edges generally better match with the counterpart of the tab in the sound-producing mechanism, thus improving the reliability of the mechanism.

Typical dimensions of the tab are a projecting length with respect to the bottom wall of the inner shell in the order of a few millimetres, e.g. in the range of from 0.5 mm to 2.5 mm or about 1.2 mm, and a width, measured perpendicularly to this projecting length, in the range of from 2 mm to 8 mm, e.g. 4 mm. The cantilever length of the tab is generally greater than the projecting length, e.g. by a factor of 2 to 4, e.g. a factor of about 3.

In advantageous embodiments of the invention, the counterpart of the sound-producing mechanism comprises at least one cut (e.g., a cutout), which is not visible from the outside of the package. Thus, the overall appearance of the package is not affected by such a cut. Moreover, e.g., if the cut is provided in several parts of a blank of the outer shell which are superimposed upon folding of the blank in order to create a cut in double-layer material, any tolerances in alignment or register of the parts of the cut are not visible.

For example, if said part (e.g., the tab) of the sound-producing mechanism is a protrusion projecting towards a lateral wall of the outer shell, this lateral wall may comprise an inner layer covered by an outer layer, wherein the inner layer is provided with at least one cut acting as a counterpart for the protrusion. Since the inner layer including the cut is covered by the outer layer, the cut is not visible from the outside. The cut can be designed as a cutout so that material of the inner layer is missing and a depression (having at least one edge) at the inner face of the lateral wall is formed. In other embodiments, the cut distorts the material of the inner layer, thus shaping a ridge which protrudes from the inner face of the lateral wall. In both cases, the protrusion or tab is essentially elastically deformed when it slides along the edge or edges of its counterpart upon advancement or retraction of the inner shell. This effect causes a sound. Since the counterpart is made from a cut or cuts in the inner layer, its manufacture is easy and may be performed when a blank of the outer shell is prepared.

The sound-producing mechanism may comprise more than one protrusion, wherein counterparts for the respective protrusions are arranged in a staggered manner. In this way, all of the protrusions can contribute to sound production, and depending on the position of the protrusions and the counterparts thereof, the sound can be produced in a sequential pattern and at different locations of the package.

In advantageous embodiments of the invention, the inner shell is formed from a blank in which a front wall panel, a bottom wall panel and a rear wall panel are arranged along one axis and wherein lateral wall panels emerge from the front wall panel and from the rear wall panel. This arrangement easily permits the provision, in the blank, of one tab or two tabs protruding from one of the two sides or from both sides of the bottom wall panel which are not connected to the front wall panel and the rear wall panel, respectively.

In a particular version, the blank of the inner shell comprises a dust flap panel emerging from a lateral wall panel, wherein the dust flap panel comprises a pre-cut tab portion which, after folding the blank of the inner shell, overlays a tab protruding from the bottom wall panel, thus forming a double-layer tab. In this case, the pre-cut tab portion at the dust flap panel and the tab at the bottom wall panel may or may not have the same shape and/or dimensions. In any case, because a double layer is formed after the inner shell has been folded to its final shape, the resulting protrusion is stronger than a single-layer tab, which may improve the sound produced by the mechanism. The strength of the protrusion can be further increased when the two layers are glued together. Usually, the blank includes dust flap panels at both sides so that protrusions reinforced in this way may be provided at both lateral sides of the package.

Similarly, the outer shell may be formed from a blank in which a front wall panel, a bottom wall panel and a rear wall panel are arranged along one axis, and wherein two lateral wall panels emerge from the front wall panel and two lateral wall panels emerge from the rear wall panel. In this case, the lateral wall panels are adapted to form respective inner layers and outer layers of the lateral walls of the outer shell, which can be glued together to stabilize the outer shell. Moreover, the inner layers can be provided with at least one cut serving as counterpart to a protrusion, as outlined above.

In advantageous embodiments of the invention, the package comprises a cutout (aperture) in at least one wall of the outer shell, selected out of the front wall, the rear wall or the two lateral walls, which cutout is adapted to expose part of the inner shell and to enable transmitting a force onto the inner shell for moving the inner shell. Moreover, a connector between a portion of the inner shell and the lid, which engages the lid at a distance from the hinge line of the lid smaller than the dimension of the lid in a direction perpendicular to the hinge line, is adapted to push the lid into its opened state when the inner shell is moved into its advanced position and to pull the lid into its closed state when the inner shell is moved into its retracted position.

This package can be handled in a very convenient way, i.e. just by means of one hand. The user can hold it in one hand, e.g. the rear wall of the outer shell facing the palm, and can use the thumb in order to grasp through the cutout and shift the inner shell by slightly pressing onto the inner shell and moving the thumb in a direction towards the lid or away from the lid, respectively. Because of the connector, the lid opens and closes automatically.

The lid may comprise a top wall (having a front edge, a rear edge, and two lateral edges) adapted to close the top side of the outer shell when the lid is in its closed state, wherein the hinge line of the lid is located at the rear edge or at one of the lateral edges of the top wall. In this case, the inner shell may comprise a rear wall or a lateral wall having an upper edge, wherein the connector extends from this upper edge, having a first hinge line at or in the area of the upper edge, and wherein the connector has a second hinge line at the bottom side of the top wall. In the closed state of the lid, the ratio of the distance between the first hinge line of the connector and the hinge line of the lid to the distance between the hinge line of the lid and the second hinge line of the connector is in the range of from 0.5 to 1.0, or in the range of from 0.70 to 0.85, or about 0.78. Such a design of the lid and the connector is attractive and permits a reliable operation.

Moreover, a bevelled edge wall may extend from at least the edge of the top wall of the lid opposite to the hinge line. This bevelled edge wall fits into the outer shell when the lid is in its closed state so that the bevelled edge wall is accommodated in the outer shell and generally not visible. Preferably, bevelled edge walls extend from all of the edges of the top wall of the lid, except for the edge defining the hinge line. The bevelled edge walls stabilise the lid and easily enter into the outer shell when the lid is closed. This also creates an attractive appearance.

BRIEF DESCRIPTION OF THE DRAWING FIGURES

In the following, the invention is described in more detail by means of embodiments. The drawings show in FIG. 1 in parts (a) to (e) several views of an embodiment of a package for tobacco-related articles according to the invention, i.e. in part (a) an isometric view of the package, the lid being partially opened, in part (b) an isometric view of the package, the lid being fully opened and an inner shell of the package having been moved to an advanced position, in part (c) a side view of the package, the lid being closed, in part (d) a side view of the package in the state according to part (b), and in part (e) a longitudinal section through the package in a plane containing the centre longitudinal axis, FIG. 2 in part (a) a plane view of a blank for the outer shell of a package according to an embodiment of the invention, in part (b) a plane view of a blank for the inner shell of that package, and in part (c) a magnified view of a detail of part (b), FIG. 3 in part (a) a plane view of a blank for the outer shell of a package according to another embodiment of the invention and in part (b) a plane view of a blank for the inner shell of that package, FIG. 4 in part (a) a plane view of a blank for the outer shell of a package according to another embodiment of the invention and in part (b) a plane view of a blank for the inner shell of that package, FIG. 5 in part (a) a plane view of a blank for the outer shell of a package according to another embodiment of the invention and in part (b) a plane view of a blank for the inner shell of that package, and FIG. 6 a plane view of a blank for the inner shell of a package according to another embodiment of the invention.

DETAILED DESCRIPTION OF THE PREFERRED EMBODIMENTS

FIG. 1 illustrates an embodiment of a package 1 for tobacco-related articles.

The package 1 comprises an outer shell 2, a lid 4 adapted to close the outer shell 2, and an inner shell 6, which is movable within the outer shell 2 from a retracted position, see FIG. 1(*a*), to an advanced position, see FIG. 1(*b*).

The inner shell 6 accommodates a bundle 8 of tobacco-related articles, e.g. a bundle of cigarettes. The bundle 8 is provided in a conventional manner, e.g. by wrapping a plurality of cigarettes with, e.g., an aluminium foil or aluminium-laminated paper. In the state of the package 1 shown in FIG. 1(*b*), the bundle 8 can be easily opened in order to take out a cigarette.

The outer shell 2 comprises a front wall 10, a rear wall 12, two lateral walls 14 and a bottom wall 16. In the embodiment, the top side 18 provides a free cross-sectional area.

The front wall 10 includes a cutout 20, i.e. an aperture fully penetrating the front wall 10. In the embodiment, the cutout 20 is located approximately in the centre area of the front wall 10.

The lid 4 is connected to the upper edge of the rear wall 12 via a hinge line 22 so that it can be swivelled from a closed state, see FIG. 1(*c*), to a fully opened state, see FIG. 1(*b*), FIG. 1(*d*), and FIG. 1(*e*). In the embodiment, the lid 4 comprises a top wall 24 having a front edge 26 and a rear edge 28, see FIG. 1(*d*), as well as two lateral edges 30, see FIG. 1(*a*). Its bottom side is designated by reference numeral 32, see FIG. 1(*e*). The hinge line 22 runs along the rear edge 28 of lid 4 and is designed from a fold line of the blank the outer shell is formed from.

Moreover, the lid 4 comprises a front edge wall 34 extending from front edge 26 and two lateral edge walls 36 extending from the two lateral edges 30 of the top wall 24 of lid 4. As can be seen in FIGS. 1(*a*), (*b*), (*d*) and (*e*), the edge walls 34 and 36 have a "bevelled" shape. That means, they extend from the front edge 26 and the lateral edges 30, respectively, in a somewhat inwardly inclined manner such that the edge walls 34 and 36 can enter the interior space of the outer shell 2 when the lid 4 is closed. Consequently, the edge walls 34 and 36 are not visible when the lid 4 is closed, see FIG. 1(*c*). In other words, when the lid 4 is closed, only its top wall 24 can be seen, which imparts to the package 1 a striking design.

When the lid 4 is closed, the edge walls 34 and 36 are located inside the outer shell 2 and stabilise the package 1. In the embodiment, the edge walls 34 and 36 have a triangular cross-sectional shape, see FIG. 1(*e*), which provides for a generally large strength of the edge walls 34 and 36. Moreover, the bevelled or inclined shape of the edge walls 34, 36 facilitates the closing process of the lid 4. In variants of the embodiment according to FIG. 1, the cross-sectional shape of the edge walls is not triangular, but different, e.g. more or less rounded.

The inner shell 6 comprises a front wall 40 and a rear wall 42, see FIG. 1(*e*), two lateral walls 44, see FIG. 1(*d*), as well as a bottom wall 46, see FIG. 1(*e*). The upper edge of the front wall 40 and part of the upper edges of the lateral walls 44 are arranged below the upper edge of the rear wall 42, see FIG. 1(*b*) and FIG. 1(*d*), which provides a free access area 48 for facilitating the removal of the tobacco-related articles of bundle 8.

In the area of the cutout 20 of the outer shell 2, the front wall 40 of the inner shell 6 is coated with a grip-enhancing, high-frictional material, e.g. a rubber-like material.

The inner shell 6 is coupled to the lid 4 by means of a hinged connector 50. As shown in FIG. 1(*b*), the connector 50 extends over most of the width of package 1. FIG. 1(*e*) illustrates the details of the connector 50 and explains how it works.

In the embodiment, the connector 50 extends from the upper edge of the rear wall 42 of the inner shell 6 at a first hinge line 52. The connector 50 is attached to the bottom side 32 of the top wall 24 of lid 4 at a second hinge line 54. The connector 50 can swivel about the hinge lines 52 and 54.

Moreover, in the embodiment, the distance between the first hinge line 52 and the second hinge line 54 is greater than the distance between the second hinge line 54 and the hinge line 22 of lid 4, e.g. by an amount of about 0.7 mm.

When the lid 4 is in its closed state, see FIG. 1(*c*), a user can place the package 1 in the palm of one of his or her hands, touch the front wall 40 of the inner shell 6 through the cutout 20 in the outer shell 2 with his or her thumb and move the thumb upwards. In this way, the user shifts the inner shell 6 from its retracted position upwards until it achieves its fully advanced position. During the movement of the inner shell 6, the connector 50 opens the lid 4 by swivelling it about the hinge line 22. Since during all times of this movement, the hinge lines 22, 52 and 54 form a triangle in the plane of FIG. 1(*e*), the swivel movement of the lid 4 is well-defined.

Initially, when lid 4 is closed, the ratio of the distance between the first hinge line 52 of the connector 50 and the hinge line 22 of the lid 4 to the distance between the hinge line 22 of the lid 4 and the second hinge line 54 of the connector 50 is about 0.78, in the embodiment. This implies that, on the one hand, the lid 4 experiences a sufficient torque during the initial moments of the opening movement, whereas, on the other hand, the upper edge of the inner shell 6, i.e. the first hinge line 52, is not located too much below the hinge line 22, i.e. the connector mechanism does not waste much space in top of the inner shell 6 when the inner shell 6 assumes its retracted position.

When the user moves his or her thumb downwards, the inner shell 6 is shifted back to its retracted position, and the connector 50 pulls the lid 4 down to its closed state.

Figure 2:
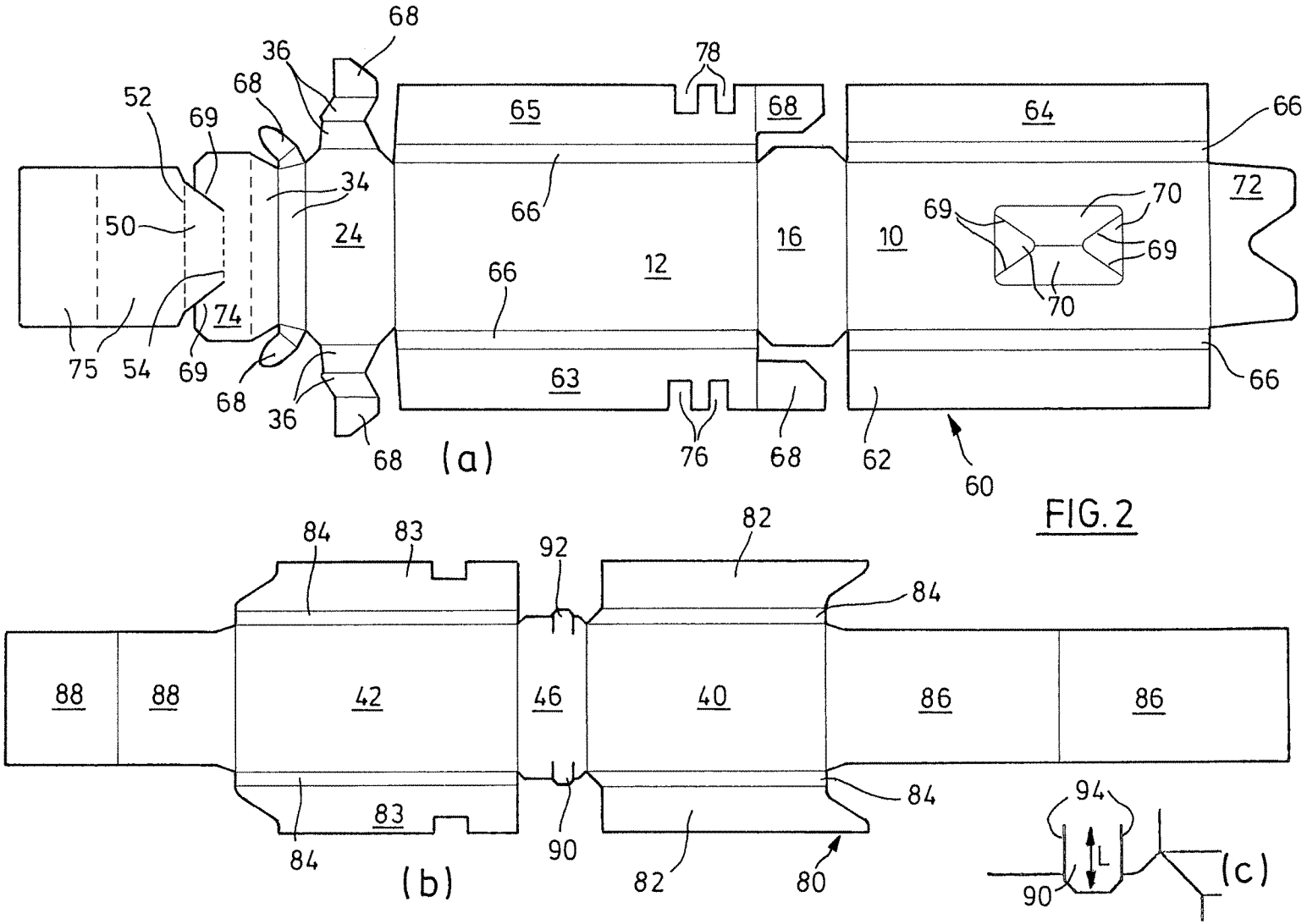

FIG. 2 illustrates a blank 60 of the outer shell 2, see FIG. 2(*a*), as well as a blank 80 of the inner shell 6, see FIG. 2(*b*). In contrast to the package according to the embodiment described by means of FIG. 1, the cross-sectional shape of the package folded from the blanks 60 and 80 is octagonal. Because of the similarity of both packages, however, in FIG. 2 the same reference numerals are used as in FIG. 1, where appropriate. In the embodiment, both blanks 60, 80 are made from cardboard of a usual thickness, e.g. in the weight range from 180 g/m$^2$ to 290 g/m$^2$. Other blank materials are conceivable as well, e.g. laminated cardboard or plastic materials.

In FIG. 2(*a*), the front wall 10, the rear wall 12, and the bottom wall 16 of the outer shell are indicated by their reference numerals. One of the two lateral walls (14 in FIG. 1) comprises an outer layer 62 which, in the folded and assembled state, is glued to an inner layer 63, the other one an outer layer 64 glued to an inner layer 65. Additionally, each of the lateral walls includes two narrow segments 66 not provided with a counter-layer, because of the octagonal cross-sectional shape of the outer shell.

Gluing tabs are designated by reference numeral 68 and any cut-through lines by reference numeral 69. The lines not indicated by reference numerals as well as the dashed lines are usual fold lines.

In the area of the cutout (20 in FIG. 1), four tabs 70 are provided which are folded back during the assemblage of the package and are glued to the inner side of the front wall 10 in order to form smooth and well-appearing edges of the cutout. Similarly, a reinforcement tab 72 is folded back during assemblage of the outer shell in order to strengthen the outer shell and form a well-appearing upper edge of the front wall 10.

FIG. 2(*a*) also illustrates how the lid 4 including its top wall 24 and the bevelled edge walls 34 and 36 is formed from the blank 60. The edge walls 34 and 36 are folded about their respective fold lines and are fixed to the lower side of top wall 24 by means of respective gluing tabs 68 and a gluing part 74, respectively. The connector 50 including its first hinge line 52 and its second hinge line 54 extends from gluing part 74. The connector 50 is joined with the inner shell 6 by means of parts 75, which also reinforce the package.

Moreover, the inner layer 63 comprises two cutouts 76, and the inner layer 65 comprises two cutouts 78. The positions of the cutouts 76 are shifted with respect to those of the cutouts 78. The cutouts 76 and 78 cooperate with tabs provided at the inner shell 6 in order to produce a sound, as described further below.

The individual steps for assembling the outer shell 2 from blank 60 are evident to a person skilled in the art. Preferably, any glue is applied in the form of spots.

In a similar way, the blank 80 of the inner shell 6 shown in FIG. 2(*b*) comprises the front wall 40, the rear wall 42 and the bottom wall 46 of the inner shell 6. Each of the lateral walls (44 in FIG. 1) includes an outer layer 82 which, in the assembled state, is glued to an inner layer 83. Additionally, each of the lateral walls includes two narrow segments 84, because of the octagonal cross-sectional shape of the inner shell. The front wall 40 of the inner shell is strengthened by reinforcement panels 86, which are folded and glued onto each other and the front wall 40, respectively. Panels 88 are folded and glued in a similar way to stabilise the rear wall 42.

FIG. 2(*b*) also shows a tab 90 and a tab 92 protruding from the sides of the bottom wall 46 of the inner shell. Each tab 90, 92 is made from the material of the bottom wall 46 and projects in a plane defined by the bottom wall. The cantilever length of each tab 90, 92 is increased by two opposed cut lines 94 in the bottom wall 46. In FIG. 2(*c*), which shows a detail of FIG. 2(*b*), the cantilever length of tab 90 is indicated by L. The elastic behaviour of the tabs 90, 92 with respect to bending and vibration is largely determined by L, but also depends on the properties of the material (in the embodiment, cardboard). In the embodiment, the tabs 90, 92 protrude by 1.2 mm with respect to the bottom wall 46, L=6 mm, and the width is 6 mm. Other dimensions of the tabs are conceivable as well. As evident in particular from FIG. 2(*c*), the free ends of the tabs 90, 92 include bevelled edges (corners).

The other lines drawn in FIG. 2(*b*) are usual fold lines. To a person skilled in the art, it is evident how the inner shell 6 is assembled from blank 80.

After assemblage of the outer shell 2 and the inner shell 6 from the blanks 60 and 80, respectively, is complete, the inner shell 6 is inserted in the outer shell 2 via top side 18, and the parts 75 are glued to the inner shell 6 so that the connector 50 is in its correct position, see in particular FIG. 1(*e*).

In the assembled state of the package, the free ends of the tabs 90 and 92 are able to enter the cutouts 76 and 78, respectively, if they are in the appropriate position along the sliding path of the inner shell 2 in the outer shell 6. When the free ends of the tabs 90, 92 enter and/or leave a cutout 76, 78, a sound is created. Generally, apart from "sliding noises", a sound may be produced whenever a tab crosses an edge of a cutout.

In the embodiment of FIG. 2, the cutouts 76 interacting with tab 90 have different positions compared to the cutouts 78 interacting with tab 92. This causes a specific temporal sequence in the sound, which may be characteristic for the package.

Figure 3:
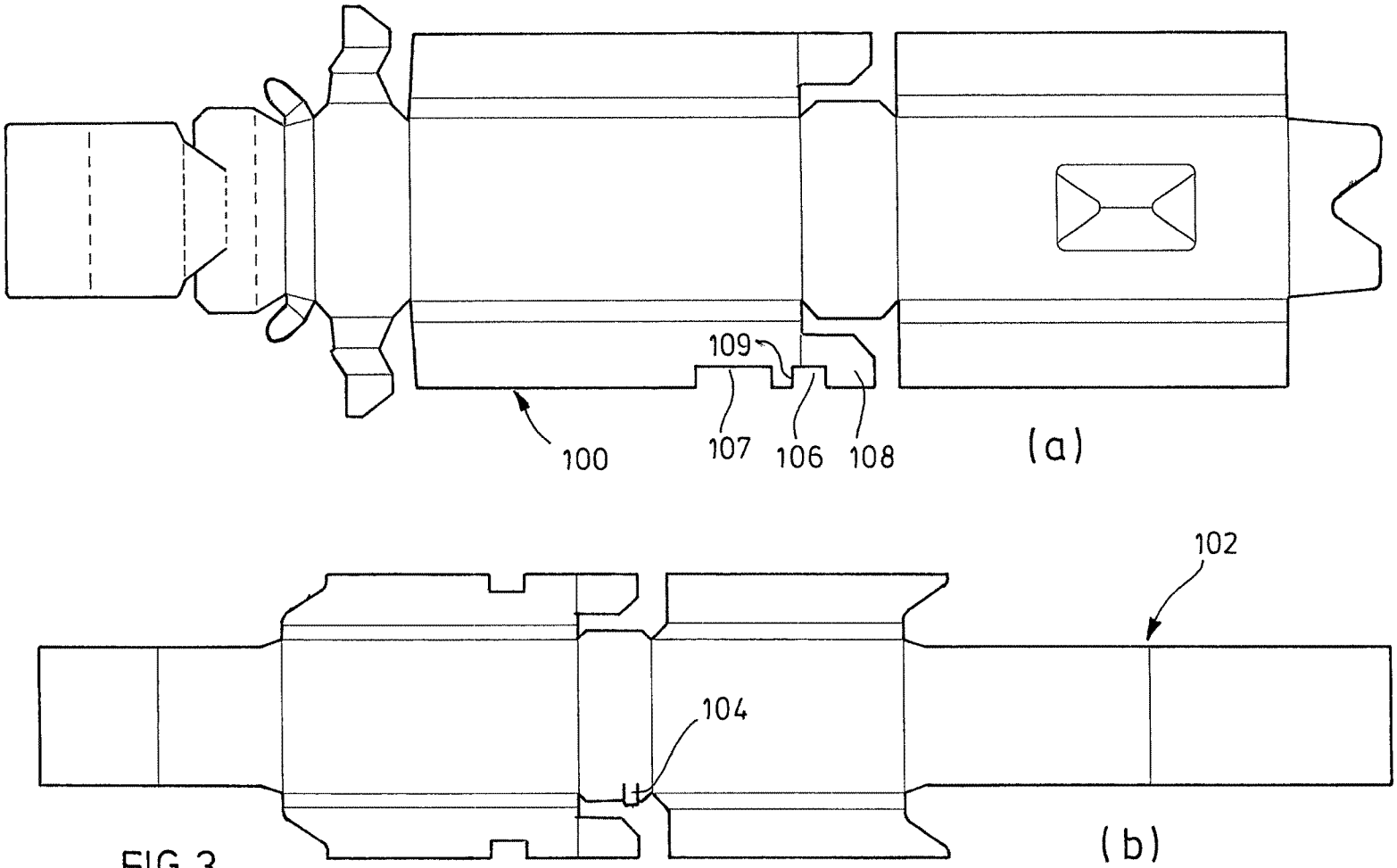

FIG. 3(*a*) shows a blank 100 for the outer shell of another embodiment of a package for tobacco-related articles, and FIG. 3(*b*) shows a blank 102 for the corresponding inner shell. The blanks 100 and 102 are very similar to the blanks 60 and 80, respectively, and differ only with respect to details of the sound-producing mechanism. For this reason, only the differences are pointed out, using some reference numerals related to the sound-producing mechanism.

The inner shell comprises only one tab 104, which can interact with two cutouts 106 and 107 provided at the outer shell. Part of the cutout 106 extends into gluing tab 108 so that, in the assembled state of the package, just a narrow portion of cutout 106 is able to interact with the tab 104. This portion holds tab 104 in a kind of lock, when the inner shell is in its fully retracted position, so that some force has to be exerted to overcome this lock when the inner shell is to be moved into its advanced position. With this lock, the lid of the package usually does not open accidentally, e.g. when the package is turned upside down. A first sound is already created when the tab 104 passes an edge 109 of cutout 106, a second one is created when the tab 104 enters cutout 107.

Figure 4:
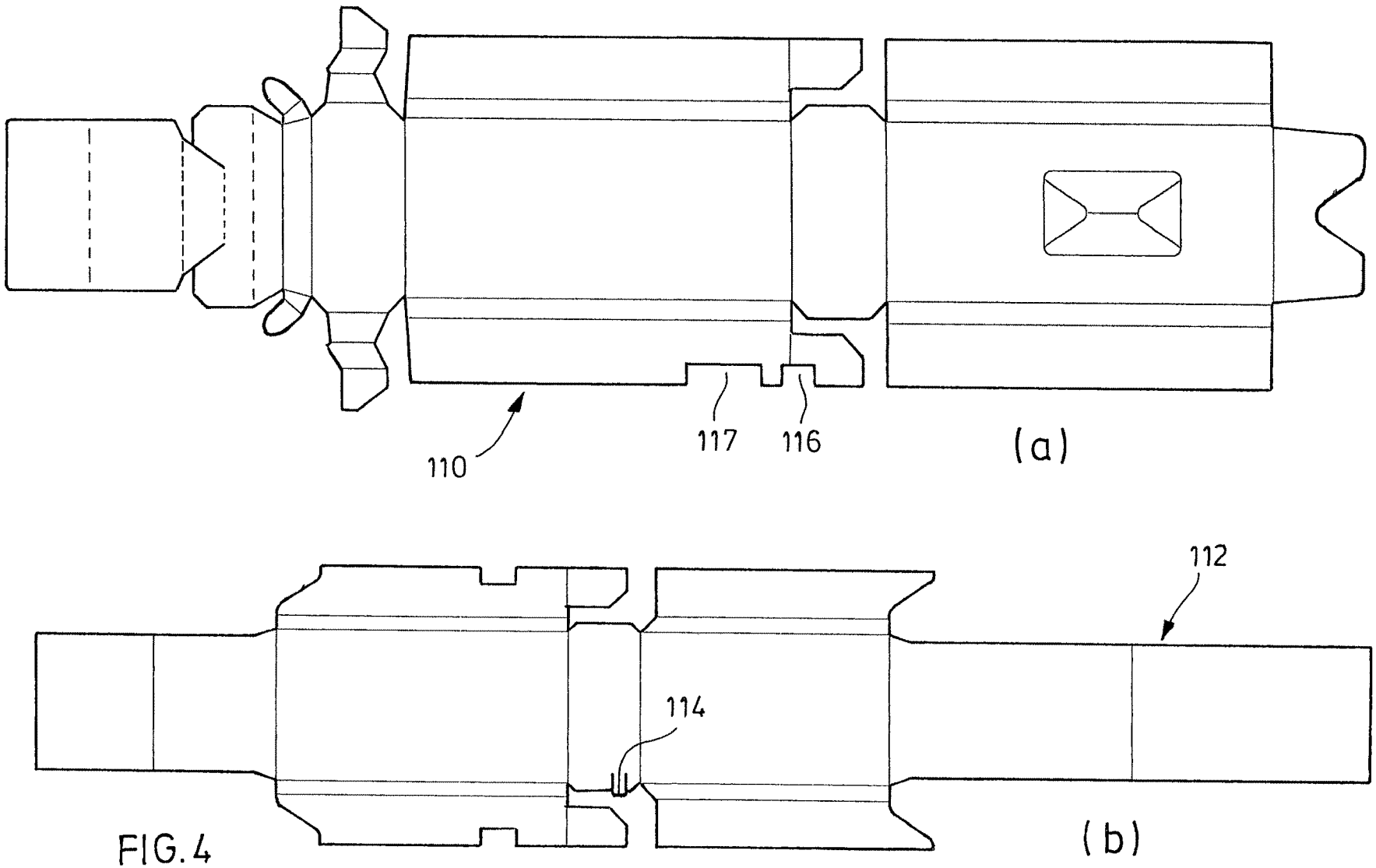

FIGS. 4(*a*) and 4(*b*) illustrate blanks 110 and 112 for the outer shell and the inner shell, respectively, of still another embodiment. This embodiment is very similar to that according to FIGS. 3(*a*) and 3(*b*). Again, one tab 114 can interact with two cutouts 116 and 117, wherein a lock is formed when the inner shell is in its fully retracted position. The distance between opposed edges of the cutouts 116 and 117, however, is greater than that at the cutouts 106 and 107 in FIG. 3(*a*) so that more time lapses between the sounds created during the movement of the inner shell.

Figure 5:
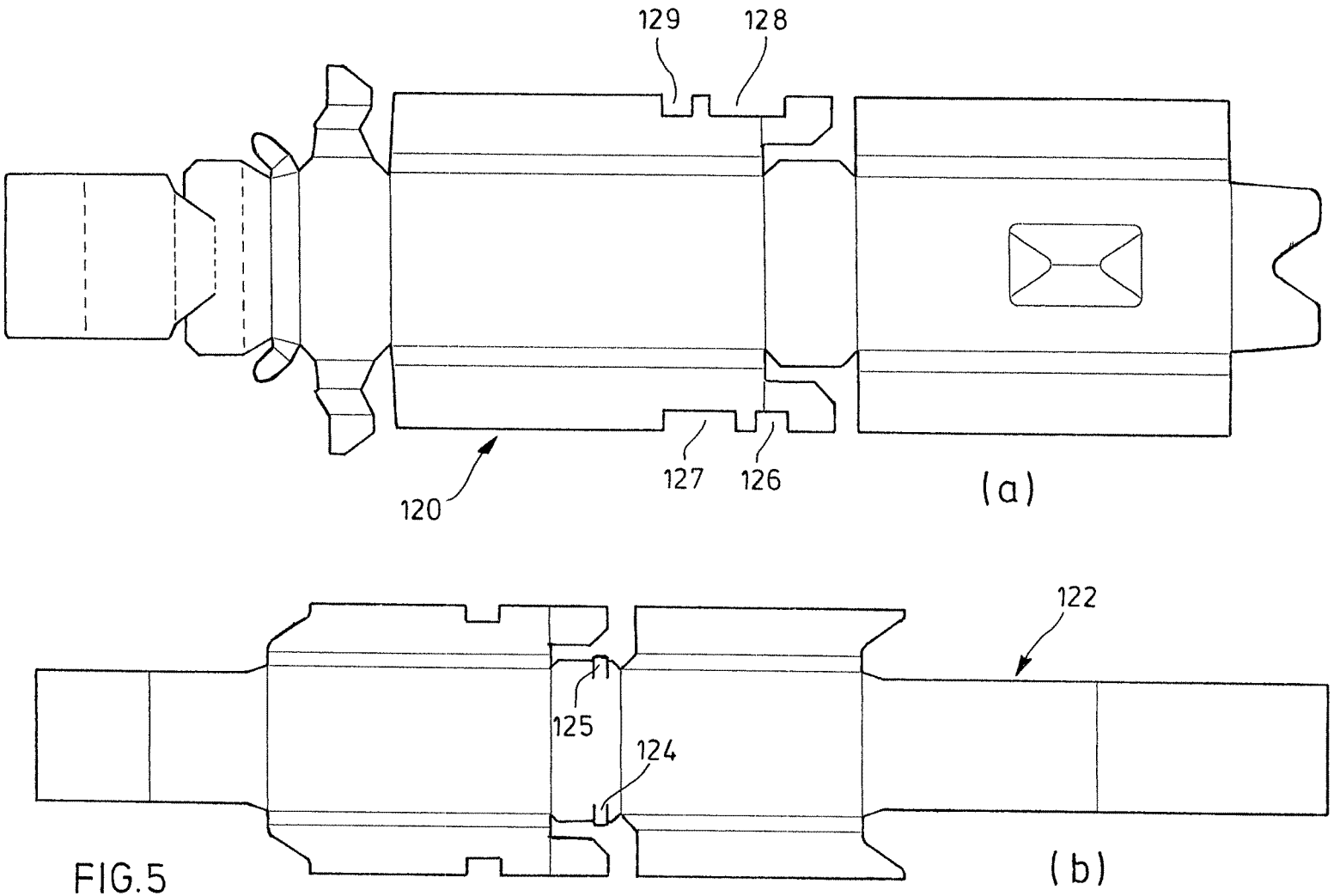

Another embodiment of a package for tobacco-related articles is explained in FIGS. 5(*a*) and 5(*b*), which show blanks 120 and 122 for the outer shell and the inner shell, respectively, of the package. The bottom wall of the inner shell comprises two tabs 124 and 125, which can interact with a total of four cutouts 126, 127, 128 and 129 provided in the inner layers of both lateral walls of the outer shell. Whereas the cutouts 126 and 127 in one of the inner layers are shaped and arranged as in the embodiment according to FIG. 3, which provides a lock action and two quick sounds, the cutouts 128 and 129 are arranged differently. When the inner shell of this embodiment is advanced, a sequence of several sounds is created.

Figure 6:
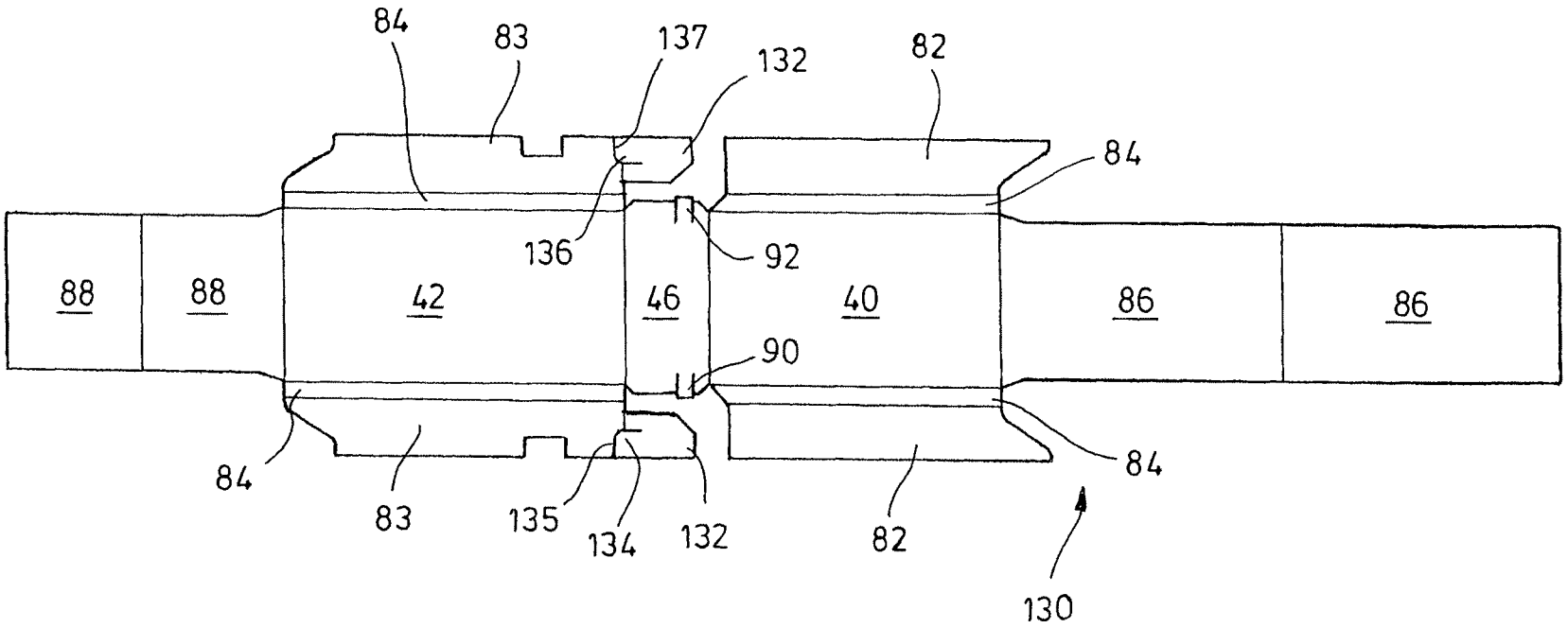

FIG. 6 shows a blank 130 for the inner shell of a further embodiment of the package. The blank 130 is similar to the blank 80 described by means of FIG. 2(*b*), and the inner shell folded from blank 130 can be used with the outer shell according to blank 60 in FIG. 2(*a*). Because of the similarities, reference numerals from FIG. 2(*b*) are also used in FIG. 6.

In addition to blank 60, blank 130 includes two dust flap panels 132, which are connected to respective lateral side panels, i.e. to the inner layers 83. One of these dust flap panels 132 comprises a tab portion 134 partially cut out by a cut line 135, and the other one of the dust flap panels 132 comprises a tab portion 136 partially cut out by a cut line 137. The cantilever length of each of the tab portions 134, 136 is increased by an extension of the respective cut line 135, 137, see FIG. 6.

After folding the blank 130 to the shape of the inner shell, the dust flap panels 132 are glued to the bottom wall 46. In this state, the tab portion 134 overlays the tab 90 protruding from the bottom wall 46, thus forming a double-layer tab. Similarly, the tab portion 136 overlays tab 92. In the embodiment, the tab portions 134 and 136 are not glued to the respective tabs 90 and 92, respectively. It is conceivable, however, that corresponding parts are fixed together, in particular if they have essentially the same shape, which would result in a more rigid double layer. In any case, the sound generated by a double-layer tab is different from that generated by a single-layer tab.

All the embodiments described so far include a connector for automatically opening and closing the lid of the package when the inner shell is moved to its advanced or retracted position, respectively. The invention is not restricted to such embodiments, however. The sound-producing mechanism may also be used in packages without such a coupling between inner shell and lid.

The invention claimed is:

1. A package for tobacco-related articles, comprising:

an outer shell having a front wall, a rear wall, two lateral walls opposite to each other connecting the front wall and the rear wall, as well as a top side;

a lid adapted to close the top side of the outer shell when in a closed state, the lid being swivelably connected to the rear wall or one of the lateral walls of the outer shell at a hinge line and being swivelable about the hinge line for transfer from the closed state to an opened state;

an inner shell adapted to accommodate a plurality of tobacco-related articles and shiftably mounted in the outer shell, wherein the inner shell is moveable towards the top side of the outer shell from a retracted position to an advanced position, which enables access to the smoking articles; and a sound-producing mechanism adapted to produce a sound when the inner shell is moved from the retracted position to the advanced position and/or from the advanced position to the retracted position, wherein the sound-producing mechanism includes at least one part arranged at the inner shell, said part being adapted to interact in a sound-producing manner with a counterpart arranged at an inner face of the outer shell.

2. The package according to claim 1, wherein said part is a protrusion projecting towards a lateral wall of the outer shell.

3. The package according to claim 1, wherein the inner shell includes a bottom wall and said part is a protrusion configured as a tab projecting from the bottom wall.

4. The package according to claim 3, wherein the tab and the bottom wall comprise the same material, and the tab projects in a plane defined by the bottom wall.

5. The package according to claim 4, wherein a cantilever length of the tab is in part defined by two opposed cut lines in the bottom wall.

6. The package according to claim 3, wherein the tab includes a free end having at least one beveled or rounded edge.

7. The package according to claim 3, wherein the tab projects with respect to the bottom wall by a length in the range of from 0.5 mm to 2.5 mm and has a width, measured perpendicularly to said projecting length, in the range of from 2 mm to 8 mm.

8. The package according to claim 1, wherein said counterpart of the sound-producing mechanism includes at least one cut which is not visible from the outside of the package.

9. The package according to claim 2, wherein said lateral wall toward which the protrusion projects includes an inner layer covered by an outer layer and at least one cut acting as a counterpart for the protrusion.

10. The package according to claim 9, wherein the cut is configured as a cutout forming a depression at the inner face of said one lateral wall.

11. The package according to claim 9, wherein the cut distorts the material of the inner layer and produces a ridge protruding from the inner face of said lateral wall.

12. The package according to claim 1, wherein the sound-producing mechanism includes a plurality of said parts configured as protrusions, and the package includes a plurality of counterparts for the respective protrusions arranged in a staggered manner.

13. The package according to claim 1, wherein the inner shell is formed from a blank in which a front wall panel, a bottom wall panel and a rear wall panel are arranged along one axis and wherein lateral wall panels extend from the front wall panel and from the rear wall panel.

14. The package according to claim 13, wherein— the part comprises a tab protruding from the bottom wall panel, the blank of the inner shell includes a dust flap panel extending from a lateral wall panel, the dust flap panel including a pre-cut tab portion which, when assembled, overlays the tab protruding from the bottom wall panel forming a double-layer tab.

15. The package according to claim 1, wherein the outer shell is formed from a blank in which a front wall panel, a bottom wall panel and a rear wall panel are arranged along one axis, and wherein two lateral wall panels extend from the front wall panel and two lateral wall panels extend from the rear wall panel, and wherein adjacent pairs of said lateral wall panels are adapted to form inner layers and outer layers of the lateral walls of the outer shell.

16. The package according to claim 1, including:

a cutout in at least one wall of the front wall, the rear wall and the two lateral walls, the cutout being adapted to expose part of the inner shell and to enable transmitting a force onto the inner shell for moving the inner shell, and a connector extending between a portion of the inner shell and the lid, the connector engaging the lid at a distance from the hinge line of the lid that is smaller than a dimension of the lid in a direction perpendicular to the hinge line and being adapted to push the lid into the opened state when the inner shell is moved into the advanced position and to pull the lid into the closed state when the inner shell is moved into the retracted position.

17. The package according to claim 16, wherein— the lid includes a top wall having a front edge, a rear edge, two lateral edges and a bottom side and is adapted to close the top side of the outer shell when the lid is in the closed state, the hinge line being located at one of the rear edge and the lateral edges of the top wall, the inner shell includes a wall having an upper edge selected from one of a rear wall and a lateral wall, the connector extending from said upper edge and having a first hinge line in the area of said upper edge and a second hinge line at the bottom side of the top wall, and in the closed state of the lid, a ratio of distance between the first hinge line of the connector and the hinge line of the lid to a distance between the hinge line of the lid and the second hinge line of the connector is in the range from 0.5 to 1.0.

18. The package according to claim 17, wherein a beveled edge wall extends from at least one of said edges of the top wall of the lid opposite to the hinge line of the lid, and the beveled edge wall fits into the outer shell when the lid is in the closed state so that the beveled edge wall is accommodated in the outer shell and generally not visible.

* * * * *